US010260379B2

(12) United States Patent
Dearman et al.

(10) Patent No.: US 10,260,379 B2
(45) Date of Patent: Apr. 16, 2019

(54) CRYOGENIC ENGINE SYSTEM

(71) Applicant: DEARMAN ENGINE COMPANY LIMITED, Croydon (GB)

(72) Inventors: Peter Dearman, Hertfordshire (GB); Michael Dearman, Hertfordshire (GB); Don Old, Middlesex (GB); Henry Clarke, London (GB); Difei Zhao, London (GB)

(73) Assignee: DEARMAN ENGINE COMPANY LIMITED, Croydon (GB)

( * ) Notice: Subject to any disclaimer, the term of this patent is extended or adjusted under 35 U.S.C. 154(b) by 0 days.

(21) Appl. No.: 15/565,245

(22) PCT Filed: Apr. 11, 2016

(86) PCT No.: PCT/GB2016/050995

§ 371 (c)(1),
(2) Date: Oct. 9, 2017

(87) PCT Pub. No.: WO2016/162692

PCT Pub. Date: Oct. 13, 2016

(65) Prior Publication Data

US 2018/0306067 A1 Oct. 25, 2018

(30) Foreign Application Priority Data

Apr. 10, 2015 (GB) ..... 1506146.8

(51) Int. Cl.
*F01K 25/06* (2006.01)
*F01B 17/02* (2006.01)
(Continued)

(52) U.S. Cl.
CPC ..... *F01K 25/06* (2013.01); *F01B 17/02* (2013.01); *F01B 17/04* (2013.01); *F01K 25/10* (2013.01); *F02G 2254/00* (2013.01)

(58) Field of Classification Search
CPC ..... F01K 25/06; F01K 25/10; F01B 17/02; F01B 17/04; F02G 2254/00
(Continued)

(56) References Cited

U.S. PATENT DOCUMENTS 4,426,847 A 1/1984 Fischer
4,747,271 A * 5/1988 Fischer ..... F01B 29/12 60/650
(Continued)

FOREIGN PATENT DOCUMENTS

WO 2006117533 A1 11/2006
WO 2013093486 A2 6/2013

OTHER PUBLICATIONS

International Search Report and Written Opinion dated Oct. 19, 2016, issued in connection with corresponding International Application No. PCT/GB2016/050995, 13 pages.
(Continued)

*Primary Examiner* — Hoang Nguyen
(74) *Attorney, Agent, or Firm* — Meunier Carlin & Curfman LLC

(57) ABSTRACT

The present invention provides a method of operating an engine (14) having one or more cylinders (16) each having a piston (18) within the cylinder (16) and each piston (18) having an expansion stroke and a return stroke and a top dead center (TDC) position and a bottom dead center position (BDC) and said engine (14) employing a working fluid (WF) and a heat exchange fluid (HEF), comprising the steps of: introducing the HEF during the return stroke of the engine; introducing the working fluid (WF) during the expansion stroke of the engine; causing the exhaust valve to be opened at or near bottom dead center of the piston BDC; delivering the HEF to the cylinder (16) after the exhaust valve has been opened; and closing the exhaust valve before TDC, such as to allow the working fluid to be compressed
(Continued)

by the piston within the cylinder. The invention also provides an engine (14) capable of being operated in accordance with the method.

20 Claims, 4 Drawing Sheets

(51) Int. Cl.
*F01K 25/10* (2006.01)
*F01B 17/04* (2006.01)

(58) Field of Classification Search
USPC ..... 60/508–515
See application file for complete search history.

(56) References Cited

U.S. PATENT DOCUMENTS

| | | | | |
|---|---|---|---|---|
| 6,983,598 | B2 | 1/2006 | Dearman | |
| 8,539,763 | B2 * | 9/2013 | McBride | F01B 23/00 60/509 |
| 2003/0136126 | A1 | 7/2003 | Dearman | |
| 2009/0211242 | A1 * | 8/2009 | Dearman | F01B 9/06 60/516 |

OTHER PUBLICATIONS

Search Report under Section 17 of the GB Intellectual Property Office, dated Sep. 23, 2015, issued in connection with Application No. GB1506146.8, 4 pages.

* cited by examiner

Fig.2 - TF ratio improvement
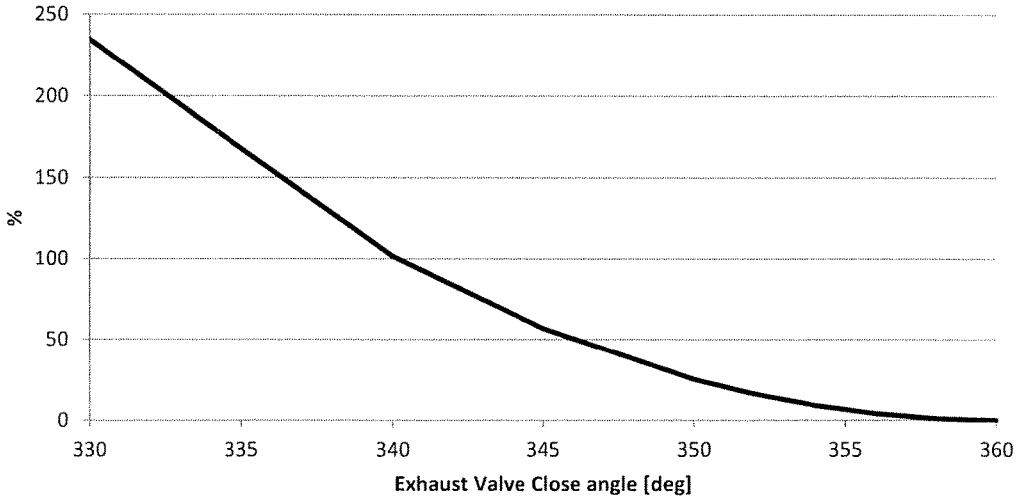
Fig.3 - Exhaust and HEF Valve Timings with crank angle (WF injection indicative)
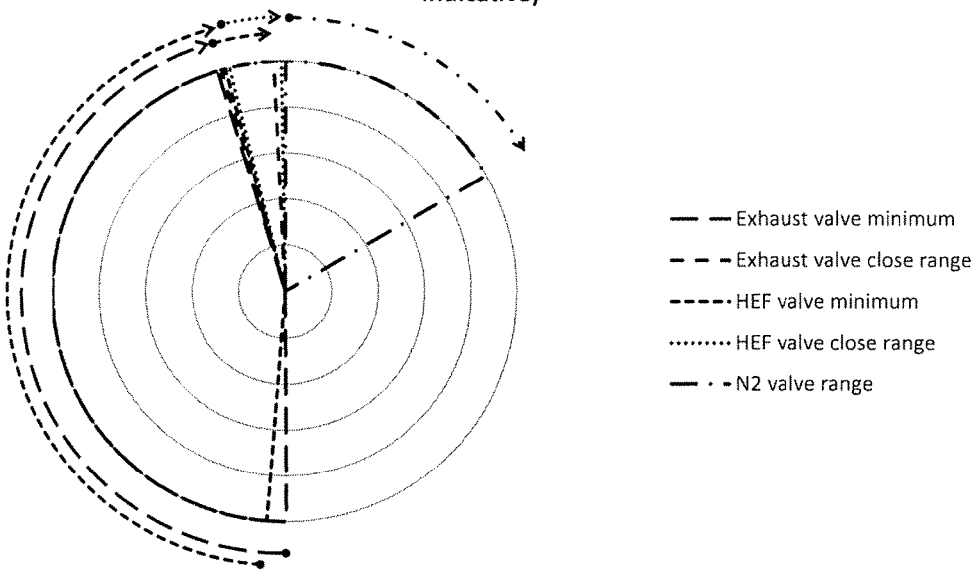

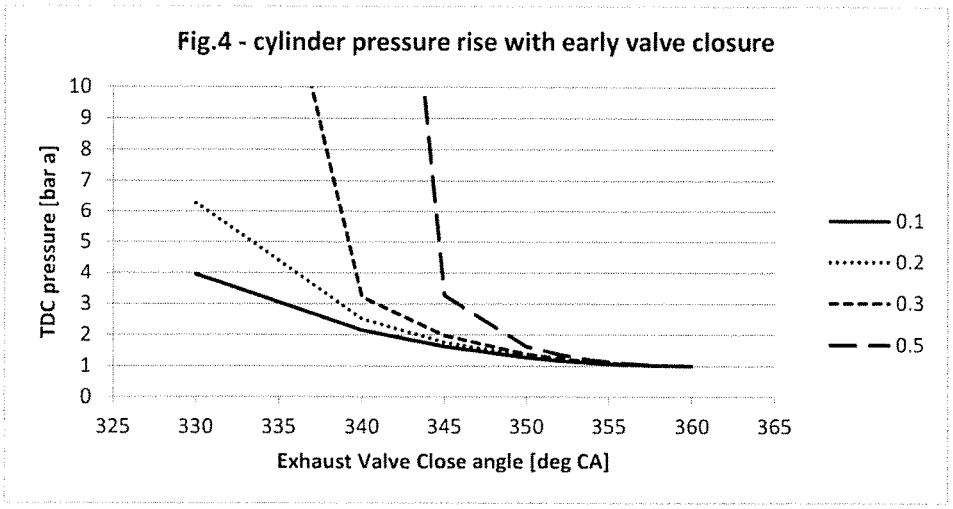
Fig.5
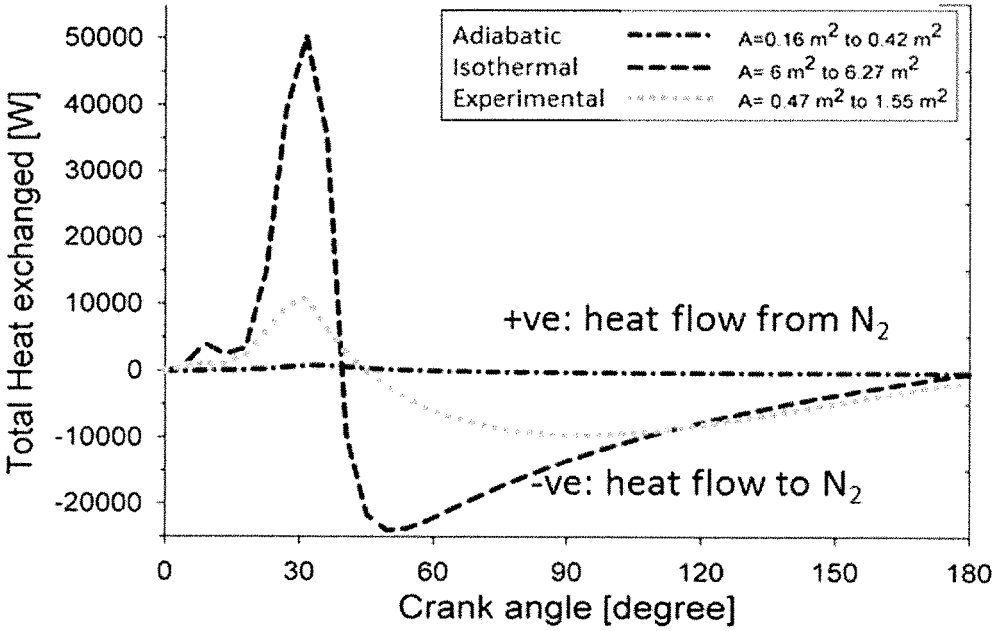

CRYOGENIC ENGINE SYSTEM

FIELD OF THE INVENTION

The present invention relates to engine systems using a working fluid (WF) and a heat exchange fluid (HEF) and relates particularly but not exclusively to such engines using liquid cryogenic fuel as the working fluid and relates still more particularly but not exclusively to apparatus and methods for improving efficiency of such engines.

BACKGROUND OF THE INVENTION

A cryogenic engine is an engine which uses a working fluid (WF) and a heat exchange fluid (HEF) at an elevated temperature relative to the WF to transfer heat to the working fluid. The cryogenic engine introduces the working fluid to an expander of the engine which expands the working fluid to do work.

In order to transfer heat to the working fluid, the HEF comes into thermal contact with the working fluid. The HEF is generally mixed with the working fluid and then recovered. The cryogenic engine may additionally comprise a heat exchanger for transferring heat to the working fluid. The working fluid and the HEF may be introduced to the expander separately, where they become mixed, and/or the HEF may come into thermal contact with the working fluid before the working fluid is introduced to the expander.

The working fluid may be stored at very low temperatures before heat is transferred to the working fluid. By "very low temperatures" is meant temperatures at which gases such as air, nitrogen, oxygen and natural gas are in a liquid phase at atmospheric pressure. Thus the storage temperature is always less than about −150 degrees Celsius. However, once heat has been transferred to the working fluid, the working fluid is at a temperature above the storage temperature, usually significantly above the storage temperature, and most usually at or near to ambient temperature, which is in a range of from about +5 to about +25 degrees Celsius, although it may be at a temperature below 0 degrees Celsius. For refrigeration-related applications, the working fluid is usually in a range from about 0 to about +30 degrees Celsius and for waste-heat recovery applications, in a range of from about +60 to about +100 degrees Celsius.

The working fluid may be a liquefied gas as it is introduced to the expander, and the expander may then vaporize the working fluid, or the working fluid may already be in the vapour phase but under pressure or in a supercritical state before it is introduced to the expander. By a "supercritical state" is meant that the working fluid may be at a temperature and pressure above its critical point in the fluid's phase diagram, where distinct liquid and gas phases do not exist. Thus the expansion may involve a phase change of the working fluid from liquid to vapour, or if the working fluid is already in the vapour phase and under pressure or in a supercritical state before being introduced to the expander, it need not involve a phase change.

Ideally, the heat transferred to the working fluid by the HEF is equal to the heat which would otherwise be lost by the working fluid during its expansion, so that the expansion of the working fluid is isothermal. This is in contrast to a steam engine and to an internal or external combustion engine, for example, all of which operate by ideally adiabatic expansion of a working fluid to do work.

The present invention is a development of the cryogenic engine system described in U.S. Pat. No. 6,983,598 (Dearman 001). This engine includes one or more cylinders and a piston in each cylinder and employs a source of working fluid (WF), normally comprising a gas derived from a liquid cryogenic source, which is introduced into a chamber of the engine in combination with a heat exchange fluid (HEF) which transfers heat to the working fluid (WF) such as to cause a higher degree of expansion of the working fluid (WF) within the chamber than would otherwise be possible. The expansion of the working fluid (WF) is used to drive the piston which in turn drives an output shaft such as to produce useful shaft horsepower. The engine includes inlet and outlet valves for each of a number of cylinders and these are controlled such as to ensure both working fluid and HEF are supplied to the cylinder before the inlet valves are closed. The description provides for a flow control device which may be a timed injection pump which is operative to dispense dosages of working fluid (WF) at appropriate points of the cycle of the engine. In the example given, during the first (expansion) part of the cycle, heat exchange fluid (HEF) is drawn into the cylinder through the inlet valve and at that point working fluid (WF) is also injected into the cylinder. The working fluid is exposed to the heating effect of the heat exchange fluid (HEF) and expands and the pressure in the cylinder rises such as to cause the piston to undertake an expansion stroke. When the piston reaches bottom dead centre (BDC), an exhaust valve is opened and the expanded working fluid (WF) and heat exchange fluid (HEF) is expelled from the cylinder and routed towards a separator and reservoir for future re-use. In this arrangement, the heat exchange fluid (HEF) is drawn into the cylinder during the first part of the expansion portion of the cycle, implying the heat exchange fluid (HEF) valve is opening at or around TDC and closing sometime post TDC.

It has been found that effective control of Heat Exchange Fluid (HEF) introduction into the expansion chamber is essential to the efficient operation of the engine concept. Engine testing shows that introduction of HEF during the first phase of the expansion stroke does not allow for efficient expansion. This is because the injection of working fluid must be shifted to later in the expansion stroke where the high rate of expander volume change reduces the volumetric efficiency due to valve flow limitations.

Therefore, there is a need for an improved engine system which overcomes these issues.

SUMMARY OF THE INVENTION

The engine system of the present invention aims to provide a method of operating an engine and an engine itself which reduces and possibly eliminates the above-mentioned problems.

In view of the foregoing and in accordance with a first aspect of the invention, there is provided a method of operating an engine having one or more cylinders each having a piston within the cylinder and each piston having an expansion stroke and a return stroke and a top dead centre (TDC) position and a bottom dead centre position (BDC) and said engine employing a working fluid (WF) and a heat exchange fluid (HEF), comprising the steps of: introducing the HEF during the return stroke of the engine; introducing the working fluid (WF) during the expansion stroke of the engine; causing the exhaust valve to be opened at or near bottom dead centre of the piston BDC; delivering the HEF to the cylinder after the exhaust valve has been opened; and closing the exhaust valve before TDC, such as to allow the working fluid to be compressed by the piston within the cylinder.

Preferably, the method includes the step of introducing HEF into the cylinder no less than 5 degrees after opening the exhaust valve.

Advantageously, the method includes the step of completing the closure of the exhaust valve between 340 and 358 degrees. Alternatively, completing the closure of the exhaust valve between 345 and 350 degrees. Alternatively, completing the closure of the exhaust valve between 350 and 355 degrees.

Preferably, the method includes the step of continuing HEF introduction until after the exhaust valve is fully closed.

Advantageously, the HEF introduction is maintained until between 2 and 10 degrees after the exhaust valve is fully closed.

Preferably, the HEF introduction is ceased no later than TDC.

The method may also include the step of compressing any remaining working fluid (WF) within the cylinder between finally ceasing HEF introduction and top dead centre (TDC).

The method may also include the step of introducing working fluid (WF) into the cylinder under pressure at or between 0 degrees and 60 degrees after TDC.

Preferably, the method includes the step of controlling HEF introduction such as to create a negative heat transfer upon injection. By "negative" is meant heat transfer from the WF to the HEF.

The present invention also provides an engine system, comprising: first storage tank, for storing working fluid (WF); an engine having one or more cylinders each having a piston therein movable between a top dead centre (TDC) position and a bottom dead centre (BDC) position and each cylinder having an inlet valve and an exhaust valve; a first delivery system, for delivering working fluid from the first storage tank and to the engine; a second storage tank for storing heat exchange fluid (HEF); a second delivery system, for delivering HEF from the second storage tank to the engine; and a controller, operably connected to the first delivery system and the second delivery system and configured to cause delivery of heat exchange fluid (HEF) to the cylinder during a return stroke of the one or more pistons and for closing the exhaust valve before TDC, such as to allow the working fluid to be compressed by the piston within the cylinder.

Advantageously, said controller is configured for introducing HEF into the cylinder no less than 5 degrees after opening the exhaust valve.

Preferably, said controller is configured for completing the closure of the exhaust valve between 340 and 358 degrees. Alternatively, said controller is configured for completing the closure of the exhaust valve between 350 and 355 degrees. Alternatively, controller is configured to maintain HEF introduction until between 2 and 10 degrees after the exhaust valve is fully closed.

Preferably, the controller is configured to cease HEF introduction no later than TDC.

Advantageously, the engine includes an injector for injecting working fluid (WF) into the cylinder under pressure at or between 0 degrees and 60 degrees after TDC.

The working fluid may include at least one of liquid nitrogen, liquid air, liquefied natural gas, carbon dioxide, oxygen, argon, compressed air, compressed nitrogen or compressed natural gas.

The present invention may also be applied to a non-piston type engine such as a Wankel engine or a paddle/vane type engine and, accordingly, the present invention also provides a method of operating an engine having a working chamber having an expansion motion and a return motion and said engine employing a working fluid (WF) and a heat exchange fluid (HEF), comprising the steps of: introducing the HEF during the return motion of the engine; introducing the working fluid (WF) during the expansion motion of the engine; causing the exhaust to be opened at or near the point of maximum chamber volume; delivering the HEF to the chamber after the exhaust has been opened; and closing the exhaust before the point of minimum chamber volume such as to allow the working fluid to be compressed within the working chamber.

The present invention will now be more particularly described with reference to the accompanying drawings, in which:

FIG. 2, is a graph of through-flow (TF) ratio improvement;

FIG. 3, is a graphical representation of the exhaust operation, and heat exchange fluid and working fluid introduction angles that may be used in association with the present invention;

FIG. 4, is a graph illustrating the effect of exhaust valve closure angle on the top dead centre cylinder pressure;

FIG. 5 illustrates how HEF is used to achieve reverse heat transfer during injection.

For the purposes of brevity, the term heat exchange fluid is hereafter abbreviated to HEF and the term working fluid is abbreviated to WF. The working fluid (WF) referred to below may include at least one of liquid nitrogen, liquid air, liquefied natural gas, carbon dioxide, oxygen, argon, compressed air, compressed nitrogen or compressed natural gas. The Heat exchange fluid may include one or more incompressible or near incompressible liquids such as, for example, water, antifreeze or mixtures thereof.

Figure 1:
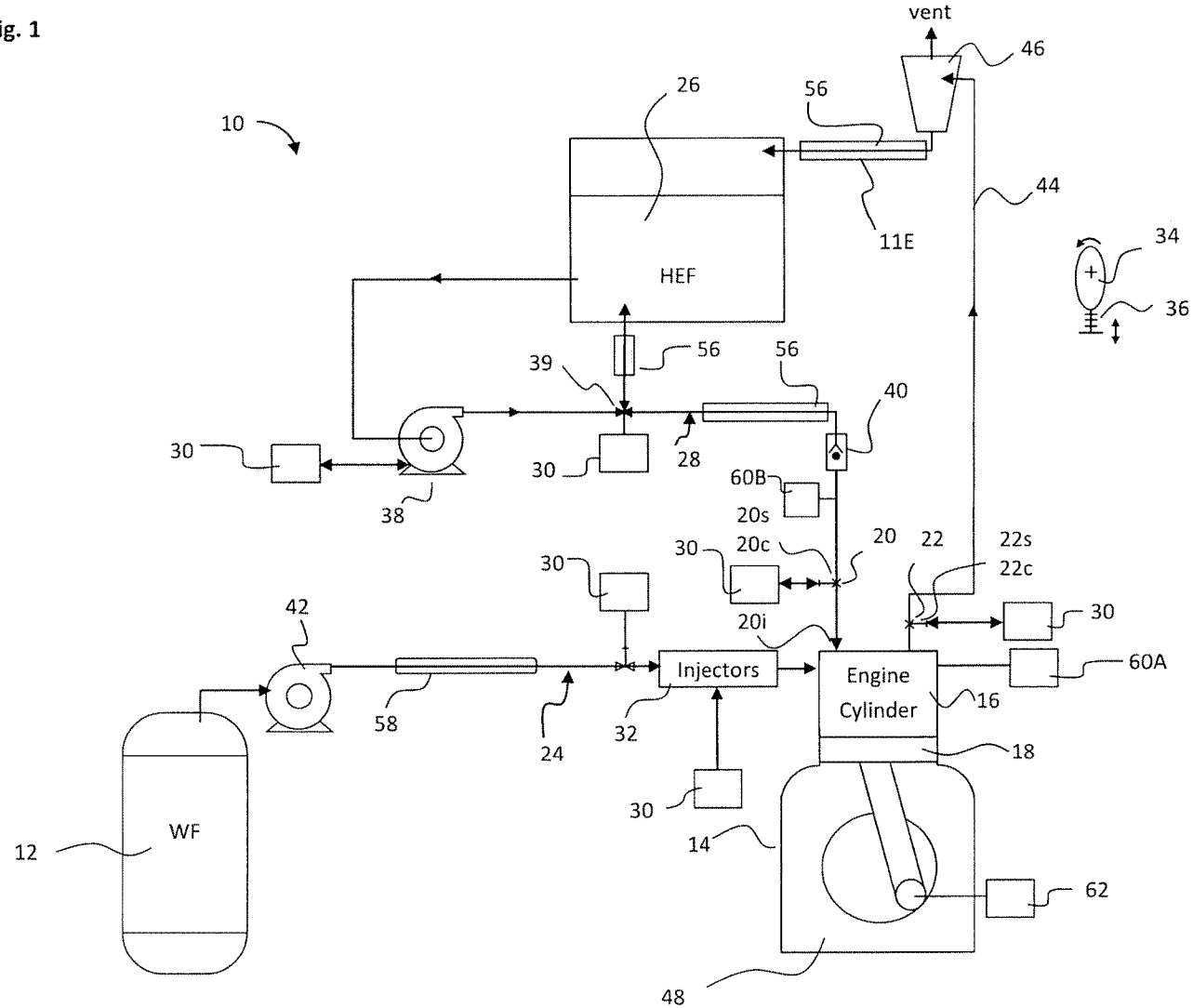
FIG. 1, is a diagrammatic representation of an engine according to one aspect of the present invention.

Referring firstly to FIG. 1, the engine system 10, includes a first storage tank 12, for storing working fluid (WF) and an engine 14 having one or more cylinders 16 each having a piston 18 therein movable between a top dead centre (TDC) position and a bottom dead centre (BDC) position and each cylinder 16 includes an inlet valve or valves 20 and an exhaust valve 22. A first delivery system 24 is provided for delivering working fluid from the first storage tank 12 and to the engine 14, whilst a second storage tank 26 is provided for storing (HEF). A second delivery system 28 is provided for delivering HEF from the second storage tank 26 to the engine 14. A controller 30 is provided and is operably connected to the first delivery system 24 and the second delivery system 28 and configured to cause delivery of heat exchange fluid (HEF) and working fluid (WF) to the cylinder in accordance with a desired control strategy, which is discussed in detail later herein. The form of controller 30 will depend upon the method of HEF and working fluid delivery. In one arrangement, the working fluid (WF) is delivered directly into the one or more cylinders 16 by means of an injector 32 in flow connection with both the first delivery system 24 and the interior of the cylinder or cylinders 16 themselves. In an alternative arrangement, the working fluid (WF) may be supplied to an inlet port 20*i* associated with inlet valve 20 such as to allow working fluid to be supplied to the cylinder or cylinders 16 via the inlet valve 20, the operation of which is under the control of the controller 30. Both the inlet valve 20 and exhaust valve 22 may comprise solenoid valves 20*s*, 22*s* or cam actuated spring loaded valves 20*c*, 22*c*, as shown diagrammatically in FIG. 1. If solenoid valves are used, the controller 30 is connected to cause the opening or closing of the valves 20, 22 as and when required by controlling the supply of electrical current E to the respective solenoids. If cam actuated sprung loaded valves 20*c*, 22*c* are used then the controller 30 takes the form of one or more cams 34 associated with the valves 20*c*, 22*c* and operable to open and close said valves 20*c*, 22*c* against the action of the spring 36 associated therewith. It will be appreciated that one may use a combination of any of the above injector or valve arrangements. Heat exchange fluid (HEF) may be supplied to the one or more cylinders 16 via the second delivery system 28 which, preferably, includes a pressurising pump 38 for ensuring heat exchange fluid (HEF) is supplied under pressure to the cylinder(s) 16. The second delivery system 28 may supply heat exchange fluid (HEF) to the inlet port 20*i* and valves 20*s* or 20*c* are used to control the timing of delivery in the manner described in detail later herein. In addition, a one-way valve 40 may be provided in the second delivery system 28 such as to prevent the back-flow of heat exchange fluid or the pressurising of the heat exchange fluid delivery system 28 by working fluid (WF). The first storage tank 12 may be provided with a pressurising pump 42 on an outlet from tank 12 for causing the pressurising of working fluid being supplied to the engine 14 via the delivery system 24. The exhaust valve 22 is connected to supply any spent working fluid/heat exchange fluid mix (SWF/SHEF) to a return line 44 which directs it to a separator 46 for separation therein. The separator 46 is connected for directing any separated heat exchange fluid (HEF) back to the second storage tank 26 for subsequent re-use.

Additional components may be added to the above arrangement such as to ensure unused working fluid is returned to the first storage tank 12. The heat exchange fluid pressurising pump 38 may be a variable speed pump controlled by controller 30 such as to control the speed thereof and, hence, the amount of HEF being delivered to the engine 14. A HEF flow controller in the form of, for example, by-pass valve 39 may also be provided for controlling the flow of HEF to the engine 14. This valve 39 is also preferably connected to the controller 30 for control thereby such as to alter the supply of HEF in accordance with a desired control parameter such as to vary the output of the engine 14.

A further optional component includes a heat exchanger shown diagrammatically at 56 and positioned at one or more of the positions shown for causing the heat exchange fluid to be warmed by exchanging energy with a source of warmth. Such a source could be the waste heat from an internal combustion engine or heat within the general atmosphere surrounding the engine 14. An optional heat exchanger positioned in the working fluid delivery system 24 and shown diagrammatically at 58 can allow further utilisation of waste or ambient heat to warm the WF before injection into the engine 16 to obtain optimal expansion conditions and increase overall efficiency. Warming the HEF at any point will also help to increase the overall efficiency as any heat contained therein will greatly enhance the expansion ratio of the gas during expansion.

An in-cylinder pressure monitor, shown generally at 60 may be provided to monitor the in cylinder pressure and this may be connected to the controller 30 such as to provide a degree of control over the engine 14, as described in detail later herein. The monitor 60 may be provided to access pressure directly within the cylinder via monitor 60A or may monitor the pressure within the HEF supply line 28. As such, the monitor 60B may be provided upstream or downstream of inlet valve 20. Either monitor 60A, 60B may be used to monitor engine pressure rise in the return stroke and may be linked to the controller 30 for flow control purposes as and where desired. A cyclic engine speed monitor, shown schematically at 62 may be provided for the same purpose and connected to the controller 30 to adjust the HEF flow rate via HEF flow control valve 39 based on the pressure (or torque) generation on the return stroke, such that optimum HEF injection is achieved without entering a potentially dangerous near-hydraulic operating regime.

The present invention is aimed, in particular, at one or more of the following three areas:

a) Ensuring sufficient HEF volume is available in the cylinder such as to limit the temperature drop of the HEF as it gives up heat to the working fluid. It is known that minimal temperature drop of the HEF increases the maximum temperature of the working fluid as it is expanded as well as the rate of heat transfer (due to the temperature differential) between working and heat exchange fluids. This is essential to obtaining near-isothermal, or better than isothermal expansion (in the case of low temperature or liquid phase injection) and therefore maximum indicated efficiency;

b) Ensuring a quantity of HEF is present in the cylinder at the point of injection of the working fluid (TDC) such as to reduce the effective dead volume in the cylinder due to the near-incompressible nature of the HEF. This increases the effective expansion ratio ($V_2/V_1$) of the cylinder, which is broadly related to the efficiency for an isothermal expansion by:

$$\text{Specific work}=R*T*\ln(V_2/V_1)$$

Where the minimum V1 is limited by the high speeds required of injection the valve apparatus. For a given limitation of ~30 degrees crank angle therefore, up to a 30% improvement in expansion ratio can be achieved from a single expander with representative dimensions via the introduction of HEF, providing a possible improvement in the indicated expansion efficiency of 17%; and c) Employing reverse heat transfer, where heat is transferred from the WF to the HEF during the injection of the working fluid at high pressure, reduce temperature spikes at TDC and therefore increase the volumetric efficiency of the expander, providing benefits in power density.

Engine testing has shown that introduction of HEF during the first phase of the expansion stroke, as described in the prior art, does not allow for efficient expansion. This is because the injection of WF must then be shifted to later in the expansion stroke where the high rate of expander volume change reduces the volumetric efficiency due to valve flow limitations.

Figure 6:
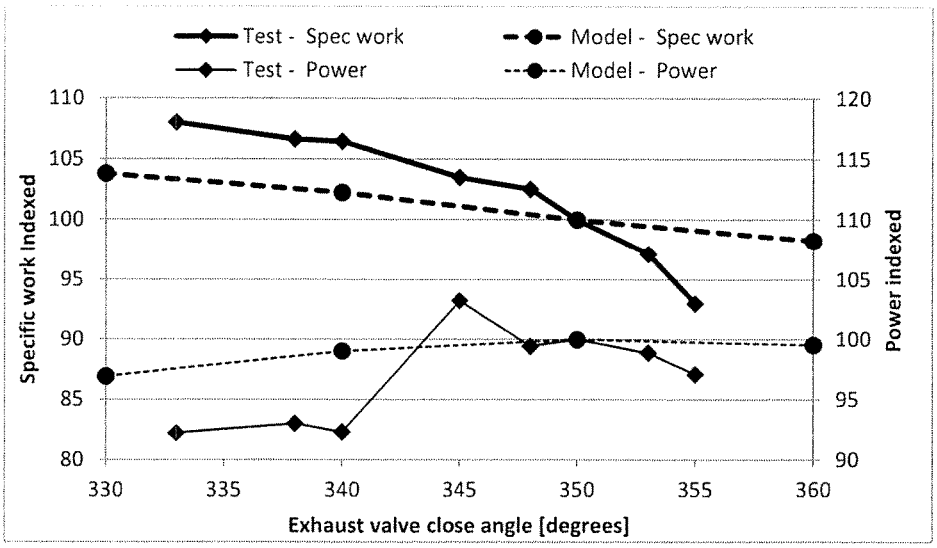
FIG. 6 is a graph showing Specific Work Index and Power Index V Exhaust Valve Closure Angle.

To overcome the above-mentioned problem, the present invention proposes the introduction of the HEF during the return stroke, when the pumping pressure required is minimal due to the lower exhaust pressures in existence at that portion of the engine cycle. Because the HEF is introduced while the previously expanded working fluid is being removed, some volume of HEF may be unavoidably lost directly through the exhaust valves, i.e. more HEF may need to be pumped into the cylinder than is expected to remain in preparation for the subsequent expansion stroke. The effectiveness of introduction of the HEF can be described as the through-flow ratio—that is the volume of HEF retained at TDC divided by the volume of HEF flowing into the cylinder. For a given required HEF volume therefore, increasing the effectiveness by increasing the through-flow ratio will reduce the HEF pumping work and thus increase the engine net efficiency. The particular timing of HEF introduction and opening/closing of the exhaust valve can also significantly improve the through-flow (TF) ratio. The present invention addresses these issues and FIG. 3 provides a summary timings diagram showing the detail of the approach taken. The HEF inlet valve opening is preferably phased such that it is no less than 5 degrees after the exhaust valve opening. This prevents residual pressure causing back-flow of the working fluid into the HEF feed which otherwise impedes the HEF introduction. The exhaust valve close is preferably completed before TDC. This traps a multiphase mixture of HEF and low pressure working fluid at a given volume fraction. As the expander volume reduces further the volume of the compressible working fluid is reduced, while the volume of the near-incompressible HEF remains unchanged, thus increasing the volume fraction of HEF ($V_{HEF}/V_{working\ fluid}$) at TDC. Any work done in compression at this stage is recovered in the subsequent expansion. Optimal timing for the exhaust valve close falls between 340 and 358 degrees crank angle, preferably between 345 and 350 degrees (max power) or alternatively between 350 and 355 degrees (mid-range best compromise). The reader is drawn to FIG. 6 of the attached drawings.

It has been found that later exhaust valve close has little benefit in TF ratio and this is represented graphically in FIG. 2, which shows the TF ratio improvement for a number of exhaust gas closure angles and from which it will be appreciated that at an exhaust closure angle of 345 degrees, the TF ratio is improved by 57% relative to some other closure angles. It will also be appreciated that preventing hydraulic locking of the engine is important for this type of HEF control given the combination of HEF introduction during the return stroke and early exhaust valve closing. Through use of in-cylinder or HEF manifold pressure measurement, or monitoring of cyclic engine speed, the control system 30 can be used to adjust the HEF flow rate via HEF flow control valve based on the pressure (or torque) generation on the return stroke such that optimum HEF injection is achieved without entering a potentially dangerous near-hydraulic operating regime (hydraulic locking).

It has also been found that premature exhaust valve closure risks the rapid pressure rises associated with incipient hydraulic lock, as depicted in FIG. 4, which shows the TDC pressure within the cylinder 14 for various exhaust valve closure angles and various flow rates. From FIG. 4 it will be appreciated that there is a rapid drop in TDC pressure when the exhaust valve is closed on or after 345 degrees and that, consequently, it is best to avoid early exhaust valve closure.

FIG. 5 illustrates how HEF is used to achieve reverse heat transfer during injection. In such an arrangement, the prior introduction of the heat transfer fluid (HEF) in the return stroke of the engine means the subsequently injected working fluid (WF) is injected into a pool of the heat transfer fluid (HEF) already present within the cylinder. This provides beneficial effects on the engine cycle. In particular, as the high pressure working fluid (WF) is introduced into the expansion chamber at TDC or thereafter, it undergoes some localised heating, due to irreversibility in the high velocity choked flow, stagnation in the cylinder and work performed by compression of the residual cylinder gas. Modelling has shown that having the HEF in the cylinder at TDC when injection of the working fluid begins, actually cools the nitrogen, lowering the temperature at the point of intake valve close (IVC). This reverse heat transfer during injection switches direction after IVC such that the HEF is giving up heat to the nitrogen during the remaining expansion and improving the isothermality and efficiency of the process.

The operation of the present arrangement will now be discussed with reference to FIG. 1 in particular and periodic reference to the remaining figures.

At bottom dead centre (BDC) position of the piston 18, the cylinder 16 will contain a mixture M of expanded working fluid (WF) and spent heat exchange fluid (HEF) which must be expelled from the cylinder and replaced with a fresh charge. The exhaust valve 22 is opened through the action of the controller 30 in the form of cam 34 or solenoid 22*s* such as to allow for the expulsion of the spent mixture M. Next, heat exchange fluid (HEF) is caused to be introduced into the cylinder 16 after the exhaust valve 22 has been opened for a sufficient period such as to allow at least an initial charge of the spent mixture M to be expelled from the cylinder. HEF introduction is then maintained for a period sufficient to allow a desired quantity Q thereof to be introduced whilst bearing in mind that some will be expelled through the open exhaust valve which is maintained open during the HEF introduction. The ratio of retained HEF to expelled HEF is referred to above as the through flow (TF) ratio.

It will be appreciated that by delaying the introduction of HEF until the initial charge of spent mixture M has been ejected from the cylinder 16 there will be relatively little driving force to cause the undesired expulsion of a portion of the newly introduced HEF with the mixture M being expelled. It will also be appreciated that ensuring sufficient HEF volume is available in the cylinder before heat exchange commences will limit the total temperature drop of the HEF as it gives up heat to the working fluid. Minimising the temperature drop of the HEF increases the maximum temperature of the working fluid (WF) as it is expanded as well as the rate of heat transfer (due to the temperature differential) between working and heat exchange fluids. This is essential to obtaining near-isothermal, or better than isothermal expansion (in the case of low temperature injection) and therefore maximum indicated efficiency.

Whilst it will be appreciated that the delay between opening the exhaust valve 22 and introducing the HEF needs to be as big as possible, it has been found that delaying HEF introduction by no less than 5 degrees is sufficient to minimise losses. The exhaust valve 22 is maintained open long enough to ensure the spent mixture M is expelled whilst also minimising any loss of fresh HEF with the mixture M being expelled.

It has been found that completing the exhaust valve closure between 340 degrees and 358 degrees is sufficient to achieve this effect. Preferably, the angle is between 345 and 350. Whilst HEF introduction may be terminated at any point between commencement and top dead centre (TDC), it has been found that maintaining HEF introduction until after the exhaust valve 22 has been fully closed is particularly beneficial as this ensures a sufficient charge of HEF is within the cylinder before the subsequent expansion stroke and also helps increase the volume fraction mentioned above. Preferably, HEF introduction is maintained until between 2 and 10 degrees after the exhaust valve 22 has been completely closed. It will be appreciated that by closing the exhaust valve before top dead centre (TDC) and ensuring there is a charge of HEF within the cylinder 16 will result in the HEF occupying a portion of the dead space within the cylinder 16 whilst the small portion of non-expelled spent working fluid (WF) will occupy the remaining portion. As the HEF is a liquid, it will be near incompressible whilst the working fluid, being in its gaseous phase, will be compressible, and will be compressed until the piston 18 reaches top dead centre (TDC). This will increase the effective expansion ratio of the working fluid once the working fluid is allowed to expand during the subsequent expansion stroke undertaken from top dead centre (TDC) onwards and greatly enhances the overall efficiency of the engine. The introduction of heat exchange fluid (HEF) is terminated no later than top dead centre (TDC).

Once the piston 18 has reached top dead centre (TDC), the working fluid (WF) is introduced into the cylinder 16 under pressure such as to overcome the pressure within the cylinder itself. Pump 42 may be used to ensure there is a sufficient pressure of working fluid (WF) for the desired expansion. Working fluid (WF) may be introduced after top dead centre and until a sufficient charge of working fluid has been introduced such as to ensure a desired expansion ratio or power output. Whilst the amount of time required to inject the desired quantity of working fluid (WF) will vary upon the pressure of supply, it has been found that useful energy may be extracted by continuing introduction up to 60 degrees after top dead centre (TDC). The early introduction of HEF into the cylinder allows for the employment of reverse heat transfer, where heat is transferred from the working fluid (WF) to the heat exchange fluid (HEF) during the injection of the working fluid. This reduces temperature spikes at TDC and therefore increase the volumetric efficiency of the expander, providing benefits in power density.

Modifications of the above within the described ranges may be made by altering the angular position of valve openings and closings and altering the timing of delivery of one or other or both of the heat exchange fluid and/or working fluid. The in-cylinder pressure monitor 60 may be used to monitor the in cylinder pressure P and may relay pressure information to the controller 30 such as to allow the controller 30 to alter one or other of the mentioned alterable parameters. Alternatively the cyclic engine speed monitor 62 or the HEF flow monitoring (valve position/flowrate or pressure) may also be used for the same purpose and connected to the controller 30 to adjust the HEF flow rate via HEF flow control valve based on the pressure (or torque) generation on the return stroke, such that optimum HEF injection is achieved without entering a potentially dangerous near-hydraulic operating regime.

Once the piston 18 has reached bottom dead center (BDC) the above process is repeated one or more times as and when required such as to ensure the delivery of useful work output from the engine 14.

The invention claimed is:

1. A method of operating an engine having one or more cylinders each having a piston within the cylinder and each piston having an expansion stroke and a return stroke and a top dead centre position and a bottom dead centre position and said engine employing a working fluid and a heat exchange fluid, comprising the steps of:

I. introducing the heat exchange fluid during the return stroke of the engine,

II. introducing the working fluid during the expansion stroke of the engine;

III. causing the exhaust valve to be opened at or near bottom dead centre of the piston;

IV. delivering the heat exchange fluid to the cylinder after an exhaust valve of the engine has been opened; and V. closing the exhaust valve before top dead centre, to allow the working fluid to be compressed by the piston within the cylinder.

2. The method as claimed in claim 1 including the step of introducing heat exchange fluid into the cylinder no less than 5 degrees after opening the exhaust valve.

3. The method as claimed in claim 2 including the step of completing the closure of the exhaust valve between 340 and 358 degrees.

4. The method as claimed in claim 2 including the step of completing the closure of the exhaust valve between 345 and 350 degrees.

5. The method as claimed in claim 2 including the step of completing the closure of the exhaust valve between 350 and 355 degrees.

6. The method as claimed in claim 2 including the step of continuing heat exchange fluid introduction until after the exhaust valve is fully closed.

7. The method as claimed in claim 2 including the step of continuing heat exchange fluid introduction until after the exhaust valve is fully closed and in which heat exchange fluid introduction is maintained until between 2 and 10 degrees after the exhaust valve (22) is fully closed.

8. The method as claimed in claim 2 including the step of continuing heat exchange fluid introduction until after the exhaust valve is fully closed and in which heat exchange fluid introduction is maintained until between 2 and 10 degrees after the exhaust valve is fully closed and in which the heat exchange fluid introduction is ceased no later than top dead centre.

9. The method as claimed in claim 2, and including the step of compressing any remaining working fluid within the cylinder between finally ceasing heat exchange fluid introduction and top dead centre.

10. The method as claimed in claim 1 including the step of introducing working fluid into the cylinder under pressure at or between 0 degrees and 60 degrees after top dead centre.

11. The method as claimed in claim 1 and including the step of controlling heat exchange fluid introduction to create a negative heat transfer upon injection.

12. An engine system, comprising:

i) A first storage tank, for storing working fluid;

ii) an engine having one or more cylinders each having a piston therein movable between a top dead centre position and a bottom dead centre (BDC) position and each cylinder having an inlet valve and an exhaust valve and;

iii) a first delivery systems for delivering working fluid from the first storage tank and to the engine;

iv) a second storage tank for storing heat exchange fluid;

v) a second delivery system, for delivering heat exchange fluid from the second storage tank to the engine;

vi) a controller, operably connected to the first delivery system and the second delivery system and configured to cause delivery of heat exchange fluid to the cylinder during a return stroke of the one or more pistons and for closing the exhaust valve before top dead centre, to allow the working fluid to be compressed by the piston within the cylinder.

13. An engine system as claimed in claim 12, wherein said controller is configured for introducing heat exchange fluid into the cylinder no less than 5 degrees after opening the exhaust valve.

14. An engine system as claimed in claim 13, wherein said controller is configured for completing the closure of the exhaust valve between 340 and 358 degrees.

15. An engine system as claimed in claim 13, wherein said controller is configured for completing the closure of the exhaust valve between 350 and 355 degrees.

16. An engine system as claimed in claim 12, wherein the controller is configured to maintain heat exchange fluid introduction until between 2 and 10 degrees after the exhaust valve is fully closed.

17. An engine system as claimed in claim 12, wherein the controller is configured to cease heat exchange fluid introduction no later than TDC.

18. An engine system as claimed in claim 12, including an injector for injecting working fluid into the cylinder under pressure at or between 0 degrees and 60 degrees after TDC.

19. An engine system as claimed in claim 12, wherein said working fluid includes at least one of liquid nitrogen, liquid air, liquefied natural gas, carbon dioxide, oxygen, argon, compressed air, compressed nitrogen or compressed natural gas.

20. A method of operating an engine having a working chamber having an expansion motion and a return motion and said engine employing a working fluid and a heat exchange fluid, comprising the steps of: introducing the heat exchange fluid during the return motion of the working chamber; introducing the working fluid during the expansion motion of the working chamber; causing an exhaust of the working chamber to be opened at or near the point of maximum chamber volume; delivering the heat exchange fluid to the chamber after the exhaust has been opened; and closing the exhaust before the point of minimum chamber volume to allow the working fluid to be compressed within the working chamber.

* * * * *